US005649370A

United States Patent [19]

Russo

[11] Patent Number: 5,649,370

[45] Date of Patent: Jul. 22, 1997

[54] DELIVERY SYSTEM DIFFUSER ATTACHMENT FOR A HAIR DRYER

[76] Inventor: Paul Russo, 2559 Cruger Ave., Bronx, N.Y. 10467

[21] Appl. No.: 621,007

[22] Filed: Mar. 22, 1996

[51] Int. Cl.[6] ..... A45D 20/10

[52] U.S. Cl. ..... 34/97

[58] Field of Search ..... 34/283, 96, 97, 34/98; 604/23, 291; 219/380; 392/385; 132/108, 112, 271, 272, 212

[56] References Cited

U.S. PATENT DOCUMENTS

| | | | |
|---|---|---|---|
| 3,943,329 | 3/1976 | Hlavac | 34/96 X |
| 4,114,022 | 9/1978 | Braulke, III | 132/212 X |
| 4,615,347 | 10/1986 | Schooley | 132/212 |
| 5,235,759 | 8/1993 | Rizzuto, Jr. | 34/97 |
| 5,241,974 | 9/1993 | Tsai | 34/97 X |
| 5,339,540 | 8/1994 | Edwards | 34/97 |
| 5,467,540 | 11/1995 | Bastien | 34/97 |

*Primary Examiner*—John Sollecito
*Assistant Examiner*—Steve Gravini
*Attorney, Agent, or Firm*—Michael I. Kroll

[57] ABSTRACT

A delivery system diffuser attachment (12) for a hair dryer (14) of the type having a motor housing (16) with air vents (18), a built-in heater coil (20), a barrel (22), a handle (24), a heat switch (26), an on-off switch (28), a cord strain relief (30) and an electrical cord (32). The diffuser attachment (12) comprises a cup member (34) having an open top end (36). A facility (37) on a bottom end (38) of the cup member (36) is for exiting an airflow (39) therethrough. A structure (40) is for retaining the cup member (34) in a removable manner adjacent a distal free end (42) of the barrel (22) of the hair dryer (14), so that the open top end (36) faces the barrel (22). An assembly (44) is for holding scented material (46) within the cup member (34). When the on-off switch (28) is manually turned on, the airflow (39) will enter the cup member (34) through the open top end (36), pick up a scented vapor (48) from the holding assembly (44) and be forced out of the airflow exiting facility (37).

17 Claims, 3 Drawing Sheets

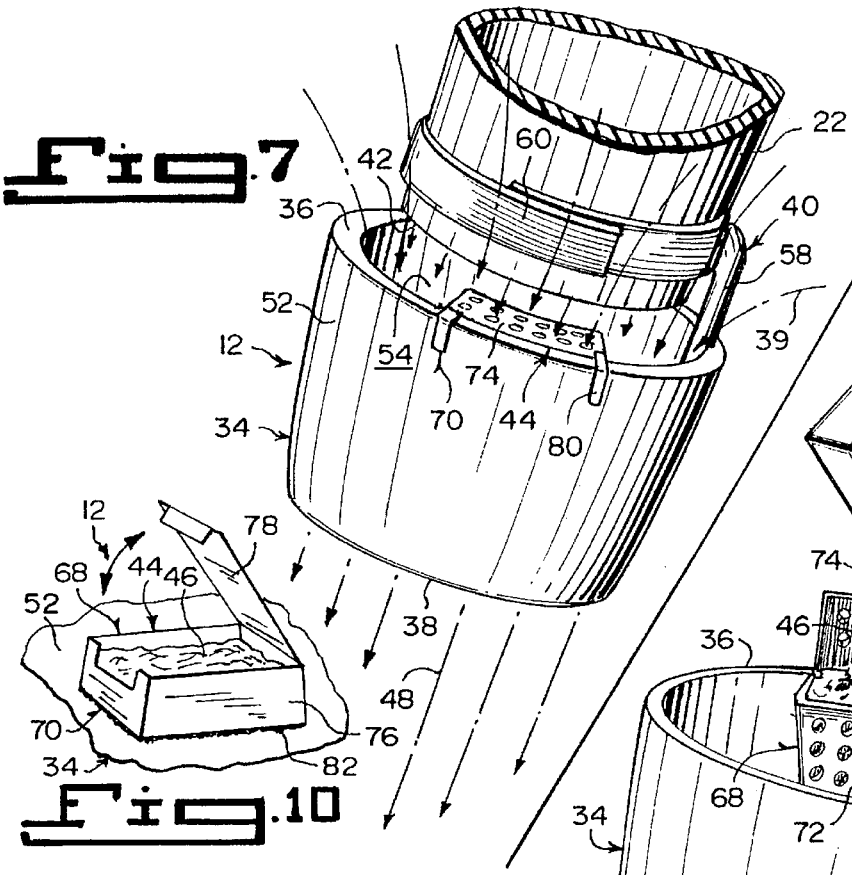
Fig. 7
Fig. 10
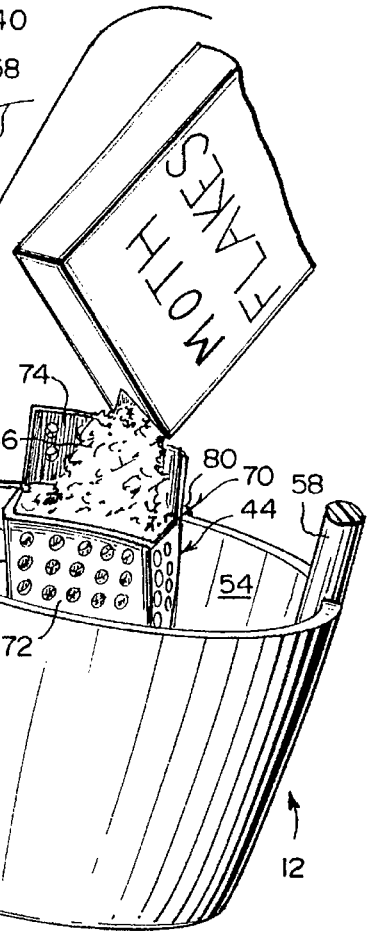
Fig. 8
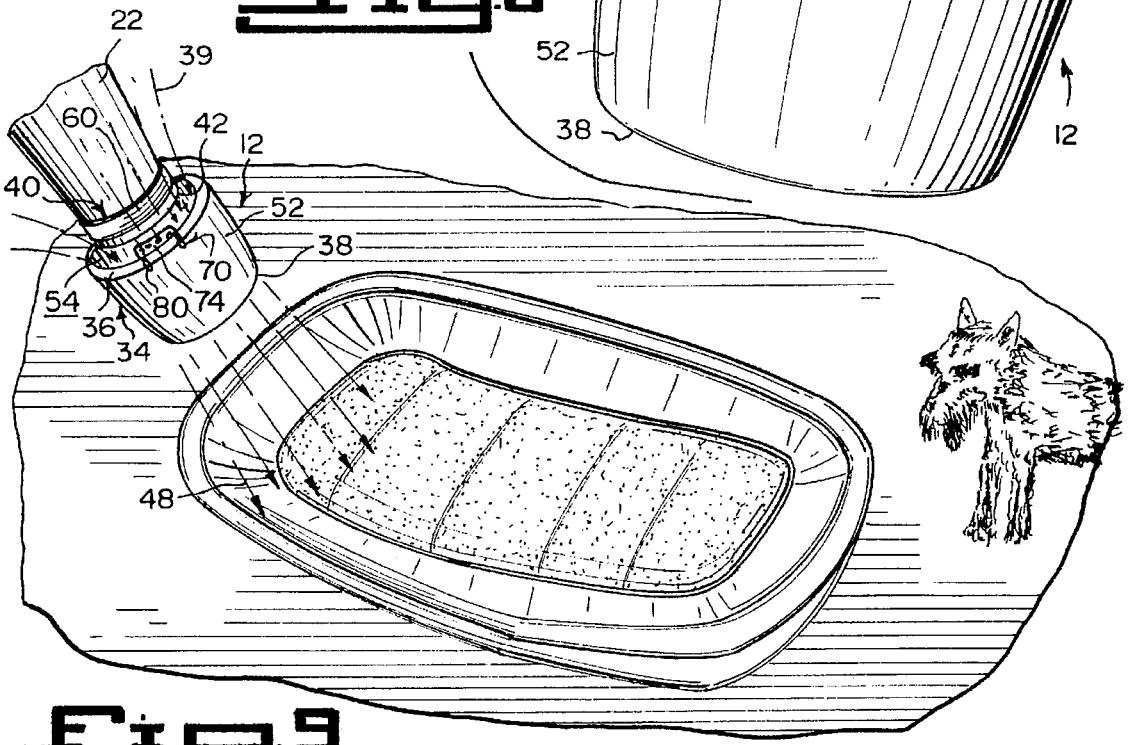
Fig. 9

DELIVERY SYSTEM DIFFUSER ATTACHMENT FOR A HAIR DRYER

BACKGROUND OF THE INVENTION

1. Field of the Invention

The instant invention relates generally to hair dryers and more specifically it relates to a delivery system diffuser attachment for a hair dryer.

2. Description of the Prior Art

Numerous hair dryers have been provided in prior art that are adapted to blow hot air upon wet hair, so as to dry the wet hair with a heated airflow therefrom. While these units may be suitable for the particular purpose to which they address, they would not be as suitable for the purposes of the present invention as heretofore described.

SUMMARY OF THE INVENTION

A primary object of the present invention is to provide a delivery system diffuser attachment for a hair dryer that will overcome the shortcomings of the prior art devices.

Another object is to provide a delivery system diffuser attachment for a hair dryer, in which the diffuser is equipped with a container holding a scented material, so that when an airflow passes through the diffuser, a scented vapor will exit therefrom.

An additional object is to provide a delivery system diffuser attachment for a hair dryer, in which the container can be constructed in a first instance to hold a particulate scented material such as moth flakes, and in a second instance to container can be constructed to hold creamed scented material such as vapor rub.

A further object is to provide a delivery system diffuser attachment for a hair dryer that is simple and easy to use.

A still further object is to provide a delivery system diffuser attachment for a hair dryer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 6:
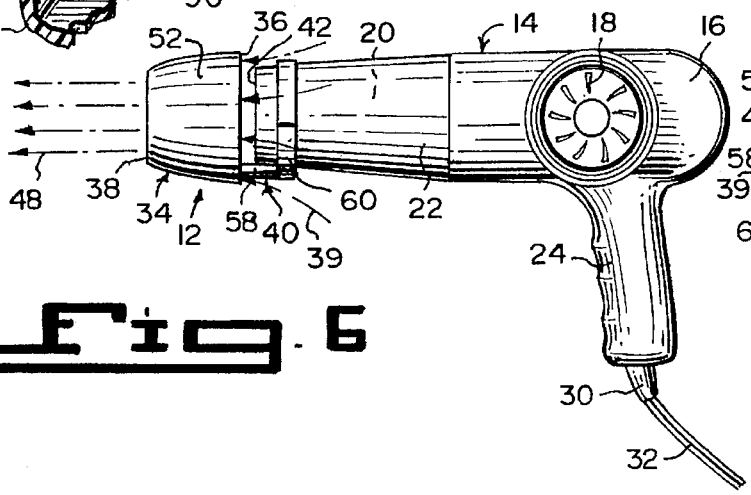
FIG. 6 is a side view of the first embodiment taken in the direction of arrow 6 in FIG. 1.
Figure 6A:
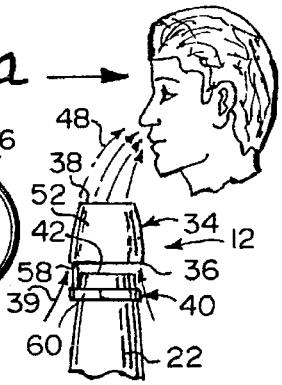

FIG. 6*a* is an elevational view with parts broken away, showing a person smelling the scented vapor therefrom.

Figure 1:
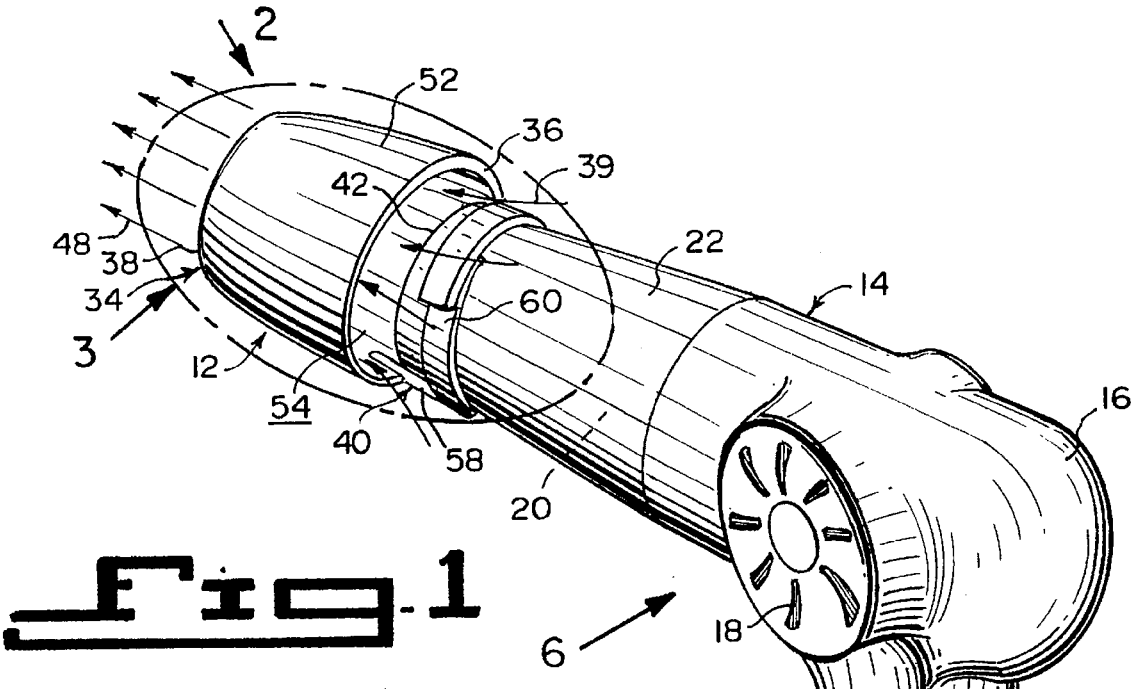
FIG. 1 is a perspective view of a first embodiment of the instant invention connected to a distal free end of a barrel on a hair dryer.
Figure 2:
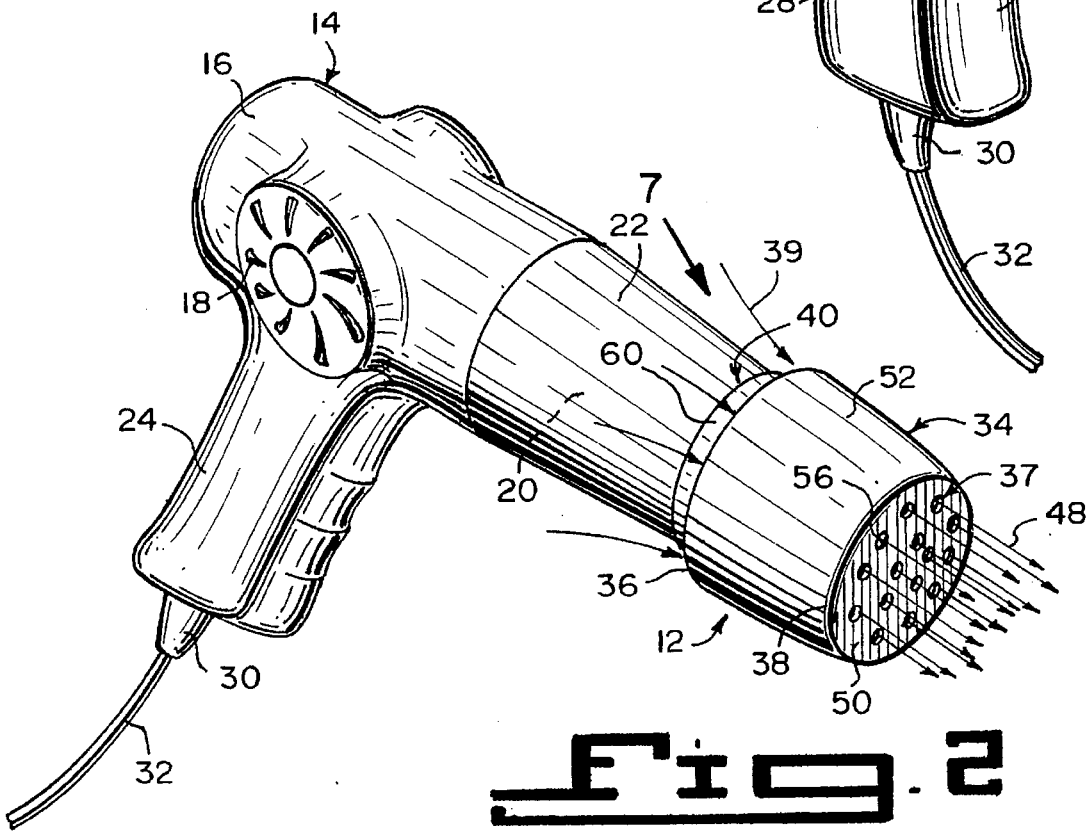
FIG. 2 is a perspective view taken in the direction of arrow 2 in FIG. 2.

FIG. 7 is an enlarged perspective view taken in the direction of arrow 7 in FIG. 2, with the barrel broken away from the hair dryer showing the airflow entering and the scented vapor exiting the cup.

FIG. 8 is an enlarged perspective view similar to FIG. 7, with the shaft broken away showing moth flakes being inserted into the container.

FIG. 9 is a perspective view, showing the first embodiment on the barrel which is broken away from the hair dryer, placing the scented vapor upon a mattress in a dog bed.

FIG. 10 is a perspective view of another type of container with its top lid open, showing a gel/cream scented material held therein.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 10 illustrate a delivery system diffuser attachment 12 for a hair dryer 14 of the type having a motor housing 16 with air vents 18, a built-in heater coil 20, a barrel 22, a handle 24, a heat switch 26, an on-off switch 28, a cord strain relief 30 and an electrical cord 32. The diffuser attachment 12 comprises a cup member 34 having an open top end 36. A facility 37 on a bottom end 38 of the cup member 36 is for exiting an airflow 39 therethrough. A structure 40 is for retaining the cup member 34 in a removable manner adjacent a distal free end 42 of the barrel 22 of the hair dryer 14, so that the open top end 36 faces the barrel 22. An assembly 44 is for holding scented material 46 within the cup member 34. When the on-off switch 28 is manually turned on, the airflow 39 will enter the cup member 34 through the open top end 36, pick up a scented vapor 48 from the holding assembly 44 and be forced out of the airflow exiting facility 37.

The cup member 34 includes a generally flat base 50 at the bottom end 38 thereof. A peripheral wall 52 extends from the base 50, so as to form a compartment 54 therein below the open top end 36. The airflow exiting facility 37 consists of the base 50 of the cup member 34 having a plurality of small holes 56.

The retaining structure 40 consists of a shaft 58 affixed at a first end to an inner surface of the cup member 34, so that a second end of the shaft 58 will extend beyond the open top end 36 of the cup member 34. A strap 60 is affixed at an inner surface thereof to the second end of the shaft 58. The strap 60 will wrap about the distal free end 42 of the barrel 22 of the hair dryer 14. A component 62 is for securing opposite ends of the strap 60 together on the distal free end 42 of the barrel 22.

Figure 3:
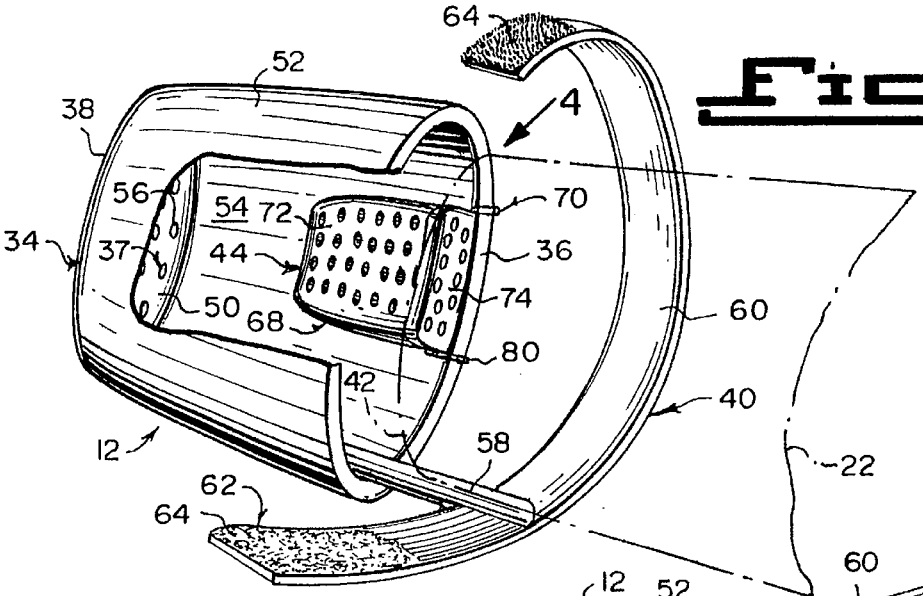
FIG. 3 is an enlarged perspective view of the area indicated by arrow 3 in FIG. 1, with part of the cup broken away, the strap opened and the barrel shown in phantom.
Figure 5:
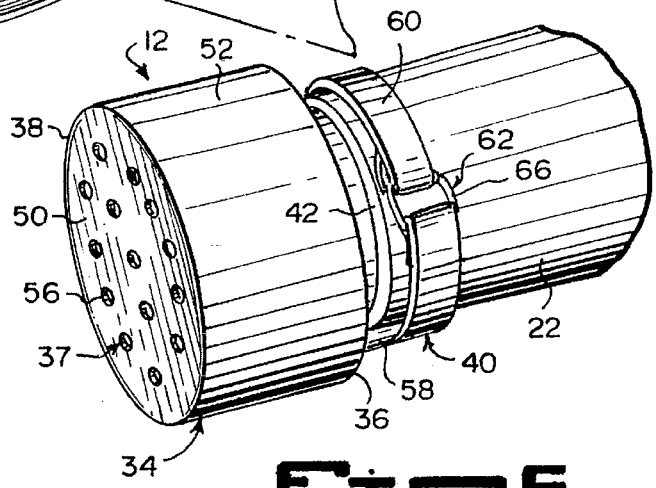
FIG. 5 is an enlarged perspective view of a second embodiment of the instant invention installed on the barrel which is broken away from the hair dryer.

The securing component 62, shown in FIG. 3, comprises mating VELCRO pads 64 on the opposite ends of the strap 60. When the strap 60 is wrapped about the distal free end 42 of the barrel 22, the opposite ends of the strap 60 will overlap and the mating VELCRO pads 64 will engage with each other, to hold the strap 60 tightly on the distal free end 42 of the barrel 22. The securing component 62 in FIG. 5 is a clasp buckle 68 on the opposite ends of the strap 60. When the strap 60 is wrapped about the distal free end 46 of the barrel 22, the clasp buckle 68 on opposite ends of the strap 60 will hold the strap 60 tightly on the distal free end 46 of the barrel 22.

The diameter of the open top end 46 of the cup member 34 is greater than the diameter of the distal free end 46 of the barrel 22, so that the airflow 39 can enter the cup member 34 from both the barrel 22 and the ambience about the barrel 22. As shown in FIGS. 1 to 4 and 6 to 9, the peripheral wall 52 is slightly tapered outwardly. The diameter of the open top end 46 of the cup member 34 is greater than the diameter of the base 50. In FIG. 5, the peripheral wall 52 is cylindrical. The diameter of the open top end 56 of the cup member 34 is of the same size as the diameter of the base 50.

The holding assembly 44 consists of a small container 68. An element 70 is for attaching the small container 68 to the interior of the cup member 34, away from the airflow exiting facility 37.

Figure 4:
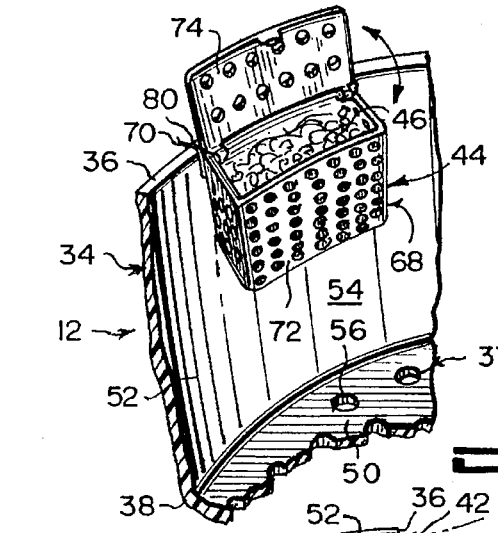
FIG. 4 is a perspective view taken in the direction of arrow 4 in FIG. 3, with the cup further broken away and the lid on the container opened.

The small container 68, as best seen in FIGS. 3, 4 and 8, comprises a perforated box 72. A perforated lid 74 is hinged to the perforated box 72. When the lid 74 is opened, the scented material 46 which is particulate can be deposited within the perforated box 72 and the lid 74 then closed, to release the scented vapor 48 therefrom.

In FIG. 10, the small container 68 includes a box 76 to hold the scented material 76 which is a gel/cream therein. A top lid 78 is hinged to the box 76. When the top lid 78 is opened the scented vapor 38 from the gel/cream scented material 76 will be released therefrom.

The attaching element 70, as best seen in FIG. 7, consists of a pair of clips 80 on the container 68. The clips 80 can be connected to an edge of the open top end 36 of the cup member 34. The attaching element 70 in FIG. 10, is adhesive 82 applied between a bottom surface of the container 68 and an interior surface of the cup member 34.

List of Reference Numbers 12 delivery system diffuser attachment for 14
14 hair dryer
16 motor housing of 14
18 air vent in 16
20 built-in heater coil in 14
22 barrel of 14
24 handle of 14
26 heat switch of 14
28 on-off switch of 14
30 cord strain relief
32 electrical cord
34 cup member of 12
36 open top end of 34
37 airflow exiting facility on 34
38 bottom end of 34
39 airflow
40 retaining structure of 12
42 distal free end of 22
44 holding assembly
46 scented material
48 scented vapor
50 base of 34
52 peripheral wall of 34
54 compartment in 34
56 small hole of 37 in 50
58 shaft of 40
60 strap of 40
62 securing component of 40
64 mating VELCRO pads for 62
66 clasp buckle for 62
68 small container of 44
70 attaching element of 44
72 perforated box of 68
74 perforated lid of 72
76 box of 68
78 top lid of 76
80 clip for 70
82 adhesive for 70

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A delivery system diffuser attachment for a hair dryer of the type having a motor housing with air vents, a built-in heater coil, a barrel, a handle, a heat switch, an on-off switch, a cord strain relief and an electrical cord, said diffuser attachment comprising:

a) a cup member having an open top end;

b) means on a bottom end of said cup member, for exiting an airflow therethrough;

c) means for retaining said cup member in a removable manner adjacent a distal free end of the barrel of the hair dryer, so that the open top end faces the barrel, said retaining means including:

i) a shaft affixed at a first end to an inner surface of said cup member, so that a second end of said shaft will extend beyond the open top end of said up member;

ii) a strap affixed at an inner surface thereof to the second end of said shaft, whereby said strap will wrap about the distal free end of the barrel of the hair dryer; and iii) means for securing opposite ends Of said strap together on the distal free end of the barrel; and d) means for holding scented material within said cup member, so that when the on-off switch is manually turned on, the airflow will enter said cup member through the open top end, pick up a scented vapor from said holding means and be forced out of said airflow exiting means.

2. A delivery system diffuser attachment for a hair dryer as recited in claim 1, wherein said securing means includes mating hook and loop type fastener pads on the opposite ends of said strap, so that when said strap is wrapped about the distal free end of the barrel, the opposite ends of said strap will overlap and said mating hook and loop type fastener pads will engage with each other, to hold said strap tightly on the distal free end of the barrel.

3. A delivery system diffuser attachment for a hair dryer as recited in claim 1, wherein said securing means includes a clasp buckle on the opposite ends of said strap, so that when said strap is wrapped about the distal free end of the barrel, said clasp buckle on opposite ends of said strap will hold said strap tightly on the distal free end of the barrel.

4. A delivery system diffuser attachment for a hair dryer of the type having a motor housing with air vents, a built-in heater coil, a barrel, a handle, a heat switch, an on-off switch, a cord strain relief and an electrical cord, said diffuser attachment comprising:

a) a cup member having an open top end;

b) means on a bottom end of said cup member, for exiting an airflow therethrough;

c) means for retaining said cup member in a removable manner adjacent a distal free end of the barrel of the hair dryer, so that the open top end faces the barrel; and d) means for holding scented material within said cup member, so that when the on-off switch is manually turned on, the airflow will enter said cup member through the open top end, pick up a scented vapor from said holding means and be forced out of said airflow exiting means, wherein said holding means includes:

i) a small container including a box to hold the scented material and a lid hinged to said box; and ii) means for attaching said small container to the interior of said cup member, away from said airflow exiting means.

5. A delivery system diffuser attachment for a hair dryer as recited in claim 4, wherein said small container includes:

a) a perforated box; and b) a perforated lid hinged to said perforated box, so that when said lid is opened, the scented material which is particulate can be deposited within said perforated box and said lid then closed, to release the scented vapor therefrom.

6. A delivery system diffuser attachment for a hair dryer as recited in claim 4, wherein said small container includes:

a) a box to hold the scented material which is a gel/cream therein; and b) a top lid hinged to said box, so that when said top lid is opened the scented vapor from the gel/cream scented material will be released therefrom.

7. A delivery system diffuser attachment for a hair dryer of the type having a motor housing with air vents, a built-in heater coil, a barrel, a handle, a heat switch, an on-off switch, a cord strain relief and an electrical cord, said diffuser attachment comprising:

a) a cup member having an open top end with a generally flat base at the bottom end thereof and a peripheral wall extending from said base, so as to form a compartment therein below the open top end;

b) means on a bottom end of said cup member, for exiting an airflow therethrough, said airflow exiting means including the base of said cup member having a plurality of small holes;

c) means for retaining said cup member in a removable manner adjacent a distal free end of the barrel of the hair dryer, so that the open top end faces the barrel, said retaining means including:

i) a shaft affixed at a first end to an inner surface of said cup member, so that a second end of said shaft will extend beyond the open top end of said cup member;

ii) a strap affixed at an inner surface thereof to the second end of said shaft, whereby said strap will wrap about the distal free end of the barrel of the hair dryer; and iii) means for securing opposite ends of said strap together on the distal free end of the barrel; and d) means for holding scented material within said cup member, so that when the on-off switch is manually turned on, the airflow will enter said cup member through the open top end, pick up a scented vapor from said holding means and be forced out of said airflow exiting means.

8. A delivery system diffuser attachment for a hair dryer as recited in claim 7, wherein said securing means includes mating hook and loop type fastener pads on the opposite ends of said strap, so that when said strap is wrapped about the distal free end of the barrel, the opposite ends of said strap will overlap and said mating hook and loop type fastener pads will engage with each other, to hold said strap tightly on the distal free end of the barrel.

9. A delivery system diffuser attachment for a hair dryer as recited in claim 7, wherein said securing means includes a clasp buckle on the opposite ends of said strap, so that when said strap is wrapped about the distal free end of the barrel, said clasp buckle on opposite ends of said strap will hold said strap tightly on the distal free end of the barrel.

10. A delivery system diffuser attachment for a hair dryer as recited in claim 7, wherein the diameter of the open top end of said cup member is greater than the diameter of the distal free end of the barrel, so that the airflow can enter said cup member from both the barrel and the ambience about the barrel.

11. A delivery system diffuser attachment for a hair dryer as recited in claim 7, wherein said peripheral wall is slightly tapered outwardly, whereby the diameter of the open top end of said cup member is greater than the diameter of said base.

12. A delivery system diffuser attachment for a hair dryer as recited in claim 7, wherein said peripheral wall is cylindrical, whereby the diameter of the open top end of said cup member is of the same size as the diameter of said base.

13. A delivery system diffuser attachment for a hair dryer as recited in claim 7, wherein said holding means includes:

a) a small container; and b) means for attaching said small container to the interior of said cup member, away from said airflow exiting means.

14. A delivery system diffuser attachment for a hair dryer as recited in claim 13, wherein said small container includes:

a) a perforated box; and b) a perforated lid hinged to said perforated box, so that when said lid is opened, the scented material which is particulate can be deposited within said perforated box and said lid then closed, to release the scented vapor therefrom.

15. A delivery system diffuser attachment for a hair dryer as recited in claim 13, wherein said small container includes:

a) a box to hold the scented material which is a gel/cream therein; and b) a top lid hinged to said box, so that when said top lid is opened the scented vapor from the gel/cream scented material will be released therefrom.

16. A delivery system diffuser attachment for a hair dryer as recited in claim 14, wherein said attaching means includes a pair of clips on said container, in which said clips can be connected to an edge of the open top end of said cup member.

17. A delivery system diffuser attachment for a hair dryer as recited in claim 15, wherein said attaching means includes adhesive applied between a bottom surface of said container and an interior surface of said cup member.

* * * * *